US007175050B1

(12) United States Patent
DeCottignies et al.

(10) Patent No.: US 7,175,050 B1
(45) Date of Patent: Feb. 13, 2007

(54) FLUID PRODUCT DISPENSER WITH RIGID SHELL AND A SOFT BAG

(75) Inventors: Laurent DeCottignies, Cergy (FR); Isabelle Binois, Chateauneuf-en-Thymerais (FR)

(73) Assignee: Airlessystems, Chareval (FR)

( * ) Notice: Subject to any disclaimer, the term of this patent is extended or adjusted under 35 U.S.C. 154(b) by 380 days.

(21) Appl. No.: 10/129,184

(22) PCT Filed: Nov. 6, 2000

(86) PCT No.: PCT/FR00/03081

§ 371 (c)(1),
(2), (4) Date: Dec. 30, 2002

(87) PCT Pub. No.: WO01/34499

PCT Pub. Date: May 17, 2001

(30) Foreign Application Priority Data

Nov. 9, 1999 (FR) ..... 99 14261

(51) Int. Cl.
*B65D 35/28* (2006.01)

(52) U.S. Cl. ..... 222/95; 222/105; 222/183; 222/321.7; 215/11.3; 215/11.6

(58) Field of Classification Search ..... 222/105, 222/95, 321.7, 321.9, 383.1, 183, 386.5; 383/80; 215/11.3, 11.6, 3, 6
See application file for complete search history.

(56) References Cited

U.S. PATENT DOCUMENTS 2,618,409 A * 11/1952 Eisenberger et al. ..... 222/95
3,232,467 A * 2/1966 Barton ..... 215/11.3
4,798,311 A 1/1989 Workum
5,263,611 A * 11/1993 Trippen ..... 222/105
5,292,033 A * 3/1994 Gueret ..... 222/95
5,337,921 A * 8/1994 Wilson et al. ..... 222/105
5,370,272 A * 12/1994 Gueret ..... 222/95
5,474,212 A * 12/1995 Ichikawa et al. ..... 222/105
5,630,531 A * 5/1997 Gaucher ..... 222/96
5,709,478 A * 1/1998 Chen ..... 383/80
5,799,810 A 9/1998 De Pous et al.
5,813,571 A * 9/1998 Gaucher ..... 222/95
5,873,491 A * 2/1999 Garcia et al. ..... 222/95
6,021,924 A * 2/2000 Suck et al. ..... 222/105
6,142,344 A * 11/2000 Kai ..... 222/183
6,336,571 B1 * 1/2002 Chibret et al. ..... 222/189.09

FOREIGN PATENT DOCUMENTS

EP 0 638 367 A 2/1995
FR 0638367 A * 2/1995
GB 2 155 117 A 9/1985
GB 2155117 A * 9/1985
WO WO 9923006 A1 * 5/1999

* cited by examiner

*Primary Examiner*—Frederick C. Nicolas
(74) *Attorney, Agent, or Firm*—Sughrue Mion, PLLC

(57) ABSTRACT

A fluid dispenser having a substantially rigid shell (1) provided with an opening (14), a flexible pouch (23) fixed to a pouch support (2) forming a fixing bushing (22) defining an outlet passageway (24) for the fluid, and a dispensing member (3) such as a pump for extracting the fluid from the flexible pouch through the outlet passageway of the pouch support; and wherein the fixing bushing (22) of the flexible support (2) is fixed in the opening (14) of the shell (1).

11 Claims, 2 Drawing Sheets

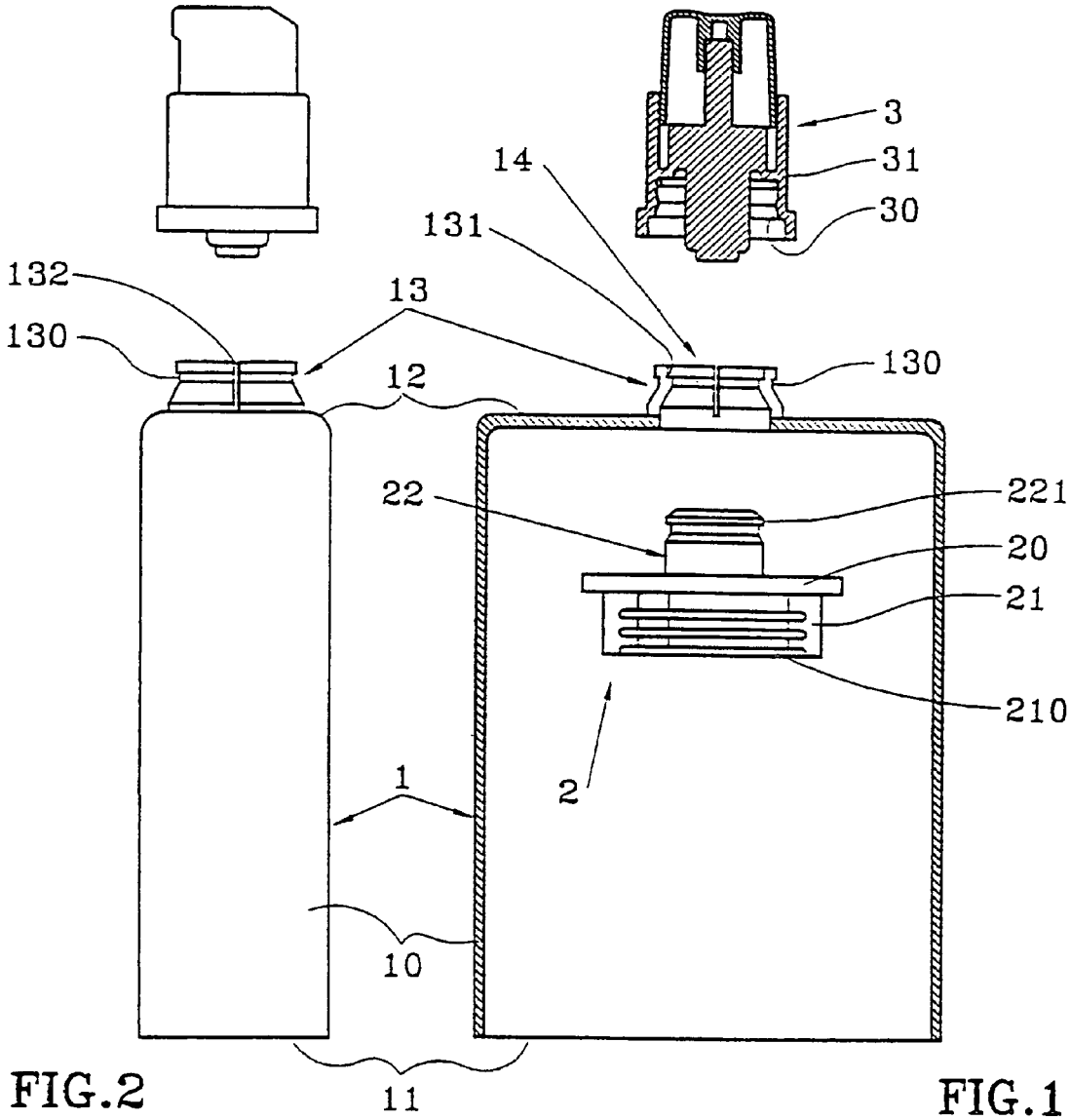
FIG.2
FIG.1
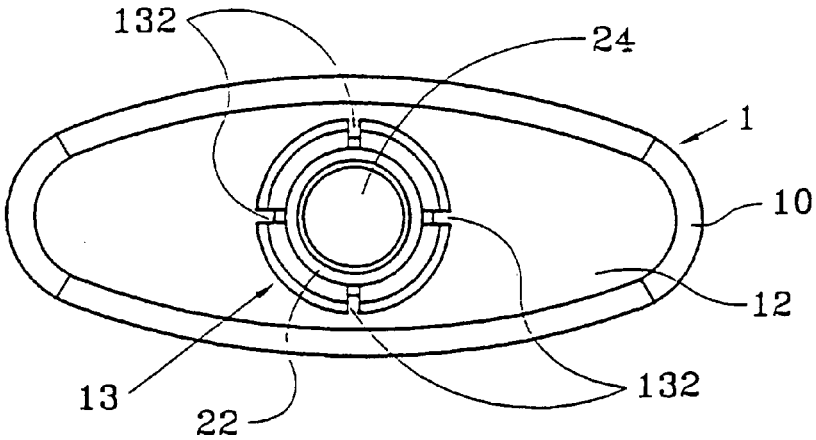
FIG.3

FLUID PRODUCT DISPENSER WITH RIGID SHELL AND A SOFT BAG

BACKGROUND OF THE INVENTION

The present invention relates to a fluid dispenser comprising a substantially rigid shell and a flexible pouch serving to contain the fluid to be dispensed. A dispensing member such as a pump is used to extract the fluid from the flexible pouch. It is known that an intermediate part can be used to fix the dispensing member to the flexible pouch, such an intermediate part serving firstly as a support for the pouch and secondly as a fixing bushing for the pump. Such a dispenser is disclosed, in particular, in Document U.S. Pat. No. 5,873,491. In that prior art dispenser, the intermediate part, which may be referred to as a "pouch support", comprises a peripheral plate having an outer periphery that is snap-fastened inside the shell. The shell is closed at its bottom, and it has an opening that is large enough to enable the flexible pouch and its pouch support to be inserted through it to complete the dispenser. Since the pouch and its support are inserted into the shell from above, it is possible for the pump to be mounted on the pouch support prior to insertion.

It has been observed that, with that type of prior art dispenser, it is possible for the pouch support to be dislodged if the dispensing member is manipulated improperly or clumsily. As a result, the pouch support is not fixed reliably to the shell.

In the prior art, Document EP-0 638 367 describes a dispenser comprising a rigid shell with a neck, a reservoir with a neck, and a pump. The bottom of the shell is open, and the reservoir is inserted into the shell via its open bottom. The neck of the shell forms an internal annular set of teeth which co-operates with a complementary set of teeth formed on the outside of the neck of the reservoir. Those sets of teeth are engaged in one another and serve as means for preventing rotation. The reservoir is fixed in the shell by screwing a pump fixing ring onto a thread formed by the neck of the reservoir. That dispenser is a refillable dispenser in which the reservoir is easy to replace. That is why the reservoir is not fixed permanently to the shell or to the pump. Properly speaking, it is not even fixed to the shell, let alone fixed permanently thereto, since the reservoir is not constrained to move with the shell if said shell is raised. In actual fact, the rotation-preventing means are unnecessary to achieve fixing, which is obtained entirely by screwing on the pump. In addition, the reservoir 1 is not a flexible pouch sealed to a support.

SUMMARY OF THE INVENTION

An object of the present invention is to overcome the drawbacks of the prior art by defining a dispenser whose pouch support is fixed securely and permanently to the rigid shell, independently of the fixing of the pump.

To this end, the present invention provides a fluid dispenser comprising a substantially rigid shell provided with an opening, a flexible pouch fixed to a pouch support forming a fixing bushing defining an outlet passageway for the fluid, and a dispensing member such as a pump, mounted in the outlet passageway of the pouch support to extract the fluid from the flexible pouch, the fixing bushing of the flexible support being fixed in the opening of the shell from the inside. Naturally, the bottom of the rigid shell is open and can be closed off by means of a separate bottom piece. The pouch support is thus inserted into the rigid shell via its open bottom, and is fixed in position in the opening in the shell. Once the pump is mounted, it is impossible to separate the pouch support from the rigid shell, since the pump is situated outside the shell, and most of the pouch support is situated inside the shell.

Another advantage of this type of fixing for fixing the pouch in the shell is that it does not involve the dispensing member (pump). Therefore, the pouch is secured to the shell in the absence of the pump. It is thus possible to fill the pouch while said pouch is already fixed in the shell. In addition, the shell serves as a support for the pouch, thereby holding it for filling, and also while the pump is being fixed. This is not achieved with the dispenser of Document EP-0 638 367.

For fixing the pouch support, the fixing bushing is provided with a snap-fastening profile serving to co-operate by snap-fastening with the opening in the shell. In which case, it is necessary merely to engage the pouch support in the shell and to force it into the opening in the shell until snap-fastening takes place.

In a first embodiment, the dispensing member is fixed to the fixing bushing. The fixing bushing then serves both as a snap-fastening member for snap-fastening to the shell, and also as a fixing member for fixing to the pump. Advantageously, the dispensing member comes into abutting contact against the rigid shell. Thus, the shell is "wedged" between the pump and the pouch support on which it is snap-fastened. Clearly, it is impossible to separate the pouch support from the shell merely by acting on the pump.

In a second embodiment, the opening in the shell is formed by a neck which projects outwards from the shell, said fixing bushing being fixed in the neck. In which case, the dispensing member is fixed to the neck of the shell. The pouch support is thus fixed, e.g. by snap-fastening, in the neck of the shell, and the pump is fixed, e.g. by snap-fastening, on the neck of the shell. The neck thus serves as fixing means both for the pouch support and for the pump. Once again, clearly it is impossible to separate the pouch support merely by acting on the pump, in particular since there is no direct mechanical link between the pouch support and the pump.

When the fixing bushing of the pouch support is snap-fastened in the neck of the shell, it is advantageous for the neck of the shell to be elastically deformable so that it can be deformed radially outwards to enable the fixing bushing to pass through the neck. The fact that the neck is elastically deformable makes it possible to facilitate snap-fastening of the fixing bushing of the pouch support. In a practical embodiment, the neck of the shell is provided with at least one vertical slot making it possible for the neck to expand radially while the fixing bushing is being put in place. By subsequently fixing the pump, e.g. by snap-fastening, onto the neck of the shell, it is possible to lock the snap-fastening of the bushing in the neck. Once the pump is mounted on the deformable neck, said neck can no longer undergo radial outward deformation.

In a practical embodiment, the neck is provided with an internal snap-fastening groove for snap-fastening the fixing bushing, and with an external snap-fastening groove for snap-fastening the dispensing member.

BRIEF DESCRIPTION OF THE DRAWINGS

The invention is described more fully below with reference to the accompanying drawings which give two embodiments of the present invention by way of non-limiting example.

In the figures:

FIG. 1 is an exploded view in vertical section through a dispenser of the present invention;

FIG. 2 is a profile view of the dispenser of FIG. 1;

FIG. 3 is a plan view of the dispenser of FIGS. 1 and 2, with the dispensing member removed;

DETAILED DESCIPTION OF THE EXEMPLARY EMBODIMENTS

Figure 5:
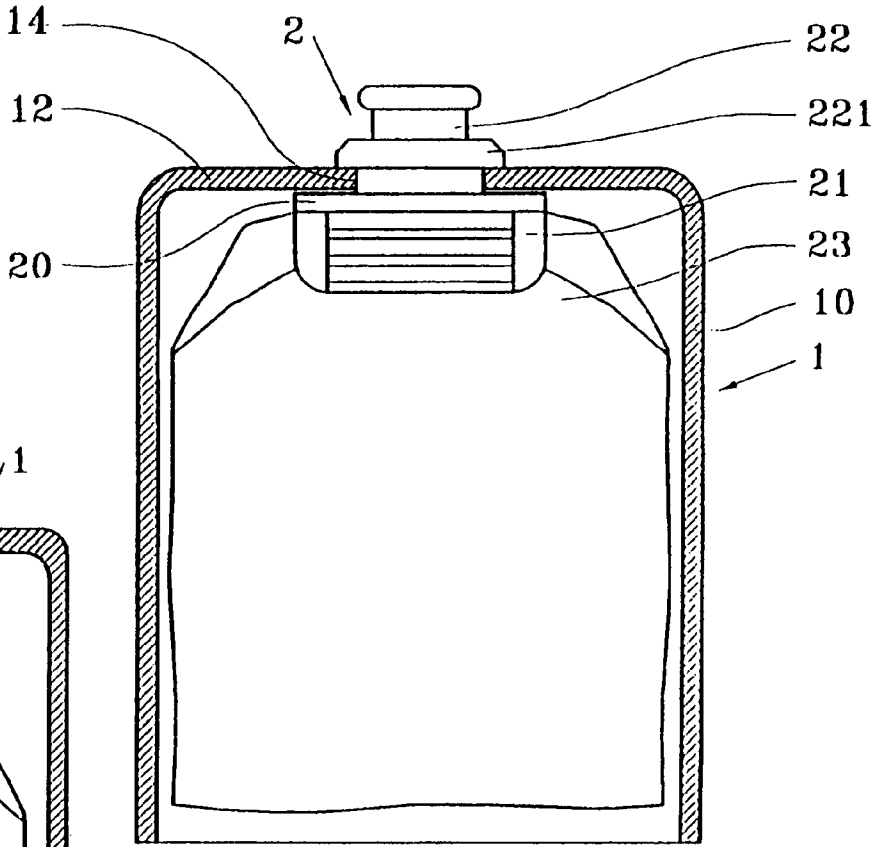
FIG. 5 is a section view through a second embodiment of a dispenser, the dispensing member being
Figure 4:
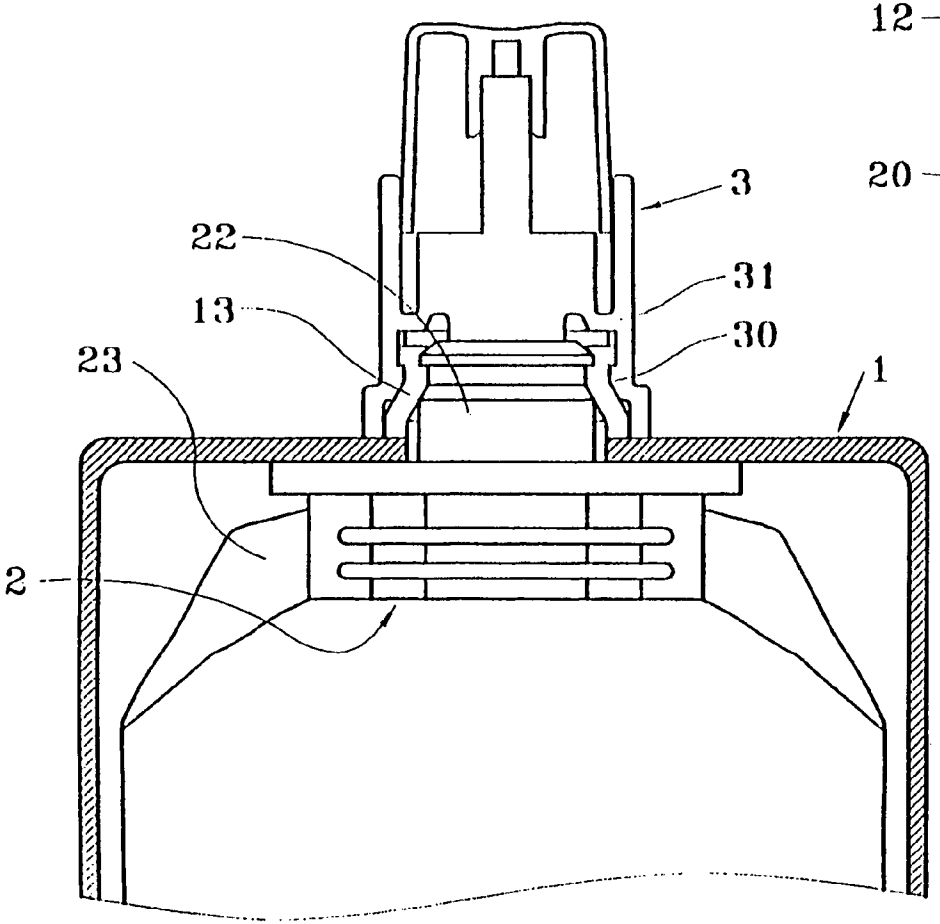
FIG. 4 is an enlarged view in section through the dispenser of FIGS. 1 to 3, in the assembled state.

In the two embodiments used to illustrate the present invention, the fluid dispenser comprises a substantially rigid shell 1, a pouch support 2 to which a flexible pouch is fixed, and a dispensing member such as a pump.

The shell may mask the entire pouch as in the example described below. However, the shell may also be in the form of a casing covering only the top portion of the pouch while leaving its bottom portion apparent.

In the figures, the substantially rigid shell 1 comprises a body 10, which is substantially cylindrical in this example, but that may also be of some other pleasing or functional shape. At its top end, the body forms a shoulder 12 which preferably centrally defines an opening 14 of relatively small size. At its bottom end, the body 10 is wide open and may optionally be closed off by a bottom piece. Therefore, the inside of the shell is easily accessible via its open bottom 11. When looking into the shell via its wide-open bottom 11, it is possible to see the opening 14 of small size in the shoulder 12.

The pouch support 2 includes a sealing appendage 21 provided with ribs 210. The flexible pouch 23 is sealed via the sealing appendage 21 so that the appendage 21 penetrates into the opening in the flexible pouch. Above the sealing appendage 21, the pouch support 2 defines a plate 20 from which a fixing bushing projects 22. The sealing appendage 21 and the fixing bushing 22 define a through hole 24 via which the inside of the pouch 23 can communicate with the outside.

In the invention, the fixing bushing 22 of the pouch support 2 is fixed into the opening 14 of the rigid shell 1 from the inside, i.e. by inserting the pouch support 2 into the shell 1 via its open bottom 11 so as to bring the fixing bushing into the opening 14 in the shell 1. The pouch support may be fixed in the opening 14 by any technique, e.g. by screw-fastening or by snap-fastening. In an embodiment of the invention shown in FIG. 5, the opening 14 in the shell 1 is formed merely by a perforation in the shoulder 12. In addition, the fixing bushing 22 of the pouch support 2 is formed by a snap-fastening bead 221 serving to come into snap-fastening engagement with the edge of the opening 14. For this purpose, the pouch support 2 is brought into the shell 1 and the fixing bushing 22 is engaged in the opening 14, and, by exerting appropriate pressure, the flange 221 is caused to pass through to the other side of the opening 14 as shown in FIG. 5. Once in place, the pouch support 2 is in a state in which it is secured permanently to the rigid shell 1. It is then necessary merely to mount a pump on the fixing bushing 22 of the pouch support 2 to complete the dispenser.

In the embodiment shown in FIGS. 1 to 4, the opening 14 in the rigid shell 1 is formed by a neck 13 which projects outwards from the shell 1. The neck 13 has internal and external profiles that serve to co-operate with the pouch support 2 and the pump. In a practical embodiment, the neck 13 internally forms a snap-fastening groove 131, and the bushing 22 of the pouch support 2 forms a snap-fastening bead 221 serving to come into snap-fastening engagement in the groove 131. In addition, the neck 13 externally forms a snap-fastening groove serving to co-operate by snap-fastening with a snap-fastening bead 30 formed by a fixing ring 31 for fixing the pump 3. To facilitate putting the pouch support 2 in place inside the neck 13, it is possible to provide the neck 13 with vertical slots 132, e.g. with four such slots, as shown in FIG. 3, thereby imparting elasticity to the neck, so that the four neck segments defined in this way can be deformed radially outwards as the bead 221 passes through the neck 13 so as finally to reach the snap-fastening groove 131 formed by the neck 13. The pouch support is locked permanently in the neck 13 by putting the dispensing member 3 in place on the neck 13, thereby permanently locking the snap-fastening of the pouch support 2. It should be noted that, in this embodiment, the pump 3 is not in mechanical contact with the pouch support 2 since they are both snap-fastened to the same member, i.e. the neck 13 of the shell 1. It is thus strictly impossible to dislodge the pouch support by acting on the pump. The same applies in the version shown in FIG. 5, although the pump is fixed directly to the fixing bushing. If the pump is removed from the bushing, the pouch support remains snap-fastened in the opening 14 in the rigid shell.

The invention claimed is:

1. A fluid dispenser comprising a substantially rigid shell (1) provided with a bottom (11) and an opening (14), a flexible pouch (23) fixed to a pouch support (2) forming a fixing bushing (22) defining an outlet passageway (24) for the fluid, and a dispensing member (3), mounted in the outlet passageway (24) of the pouch support (2) to extract the fluid from the flexible pouch, said fluid dispenser being characterized in that the fixing bushing (22) of the pouch support (2) is fixed from the inside through the bottom (11) to the opening (14) of the shell (1) before the mounting of the dispensing member;

wherein the fixing bushing (22) is provided with a snap-fastening profile (221) serving to co-operate by snap-fastening with the opening (14) in the shell.

2. A fluid dispenser comprising a substantially rigid shell (1) provided with a bottom (11) and an opening (14), a flexible pouch (23) fixed to a pouch support (2) forming a fixing bushing (22) defining an outlet passageway (24) for the fluid, and a dispensing member (3), mounted in the outlet passageway (24) of the pouch support (2) to extract the fluid from the flexible pouch, said fluid dispenser being characterized in that the fixing bushing (22) of the pouch support (2) is fixed from the inside through the bottom (11) to the opening (14) of the shell (1) before the mounting of the dispensing member;

wherein the dispensing member (3) is fixed to the fixing bushing (22); and wherein the dispensing member (3) comes into abutting contact against the rigid shell (1).

3. A fluid dispenser comprising a substantially rigid shell (1) provided with an opening (14), the opening (14) in the shell being formed by a neck (13) which projects outwards from the shell, a flexible pouch (23) fixed to a pouch support (2) forming a fixing bushing (22) defining an outlet passageway (24) for the fluid, and a dispensing member (3) mounted in the outlet passageway (24) of the pouch support (2) to extract the fluid from the flexible pouch, wherein the fixing bushing (22) of the pouch support (2) is fixed in the neck of the opening (14) of the shell (1), and in which the bushing (22) is snap-fastened in the neck (13), and the dispensing member (3) is snap-fastened on the neck (13), thereby locking the snap-fastening of the bushing; and wherein the fixing bushing (22) is snap-fastened on the neck (13) from an inside of the shell by first inserting the fixing bushing through an opening in a bottom of the shell (1).

4. A dispenser according to claim 3, in which the neck (13) is provided with an internal snap-fastening groove (131) for snap-fastening the fixing bushing (22), and with an external snap-fastening groove (130) for snap-fastening the dispensing member (3).

5. The dispenser according to claim 3, wherein the dispenser member is a pump.

6. A fluid dispenser comprising a substantially rigid shell (1) provided with an opening (14), the opening (14) in the shell being formed by a neck (13) which projects outwards from the shell, a flexible pouch (23) fixed to a pouch support (2) forming a fixing bushing (22) defining an outlet passageway (24) for the fluid, and a dispensing member (3) mounted in the outlet passageway (24) of the pouch support (2) to extract the fluid from the flexible pouch, said fluid dispenser being characterized in that the fixing bushing (22) of the pouch support (2) is fixed in the neck of the opening (14) of the shell (1), the neck (13) of the shell being elastically deformable so that it can be deformed radially outwards to enable the fixing bushing (22) to pass through the neck:

wherein the bushing (22) is snap-fastened in the neck (13), and the dispensing member (3) is snap-fastened on the neck (13), thereby locking the snap-fastening of the bushing.

7. The dispenser according to claim 6, wherein the neck (13) is provided with an internal snap-fastening groove (131) for snap-fastening the fixing bushing (22), and with an external snap-fastening groove (130) for snap-fastening the dispensing member (3).

8. A fluid dispenser, comprising:

a substantially rigid shell (1) provided with a bottom portion (11) and an opening (14);

a pouch support (2) comprising a fixing bushing (22) that defines an outlet passageway (24);

a flexible pouch (23) containing a fluid and fixed to the pouch support (2); and a dispensing member (3) mounted in the outlet passageway (24) of the pouch support (2) so as to extract the fluid from the flexible pouch; and wherein the fixing bushing (22) of the pouch support (2) is configured for one-way insertion through the opening (14) from the inside of the rigid shell and the fixing bushing is fastened to the rigid shell prior to attachment of the dispensing member, so that the fixing bushing is fixed to prevent movement in an axial and a radial direction of the opening.

9. The dispenser according to claim 8, wherein the fixing bushing is provided with a snap-fastening profile (221) that co-operates by snap-fastening with the opening (14) in the rigid shell.

10. A fluid dispenser comprising a substantially rigid shell (1) provided with a bottom (11) and an opening (14), a flexible pouch (23) fixed to a pouch support (2) forming a fixing bushing (22) defining an outlet passageway (24) for the fluid, and a dispensing member (3), mounted in the outlet passageway (24) of the pouch support (2) to extract the fluid from the flexible pouch, said fluid dispenser being characterized in that the fixing bushing (22) of the pouch support (2) is fixed from the inside through the bottom (11) to the opening (14) of the shell (1) before the mounting of the dispensing member;

wherein the opening (14) in the shell is formed by a neck (13) that projects outwards from the shell and the bushing (22) is snap-fastened in the neck (13), and the dispensing member (3) is snap-fastened on the neck (13), thereby locking the snap-fastening of the bushing.

11. The dispenser according to claim 10, in which the neck (13) is provided with an internal snap-fastening groove (131) for snap-fastening the fixing bushing (22), and with an external snap-fastening groove (130) for snap-fastening the dispensing member (3).

* * * * *